US011398210B2

(12) United States Patent
Hasebe et al.

(10) Patent No.: US 11,398,210 B2
(45) Date of Patent: Jul. 26, 2022

(54) MUSICAL SOUND INFORMATION OUTPUTTING APPARATUS, MUSICAL SOUND PRODUCING APPARATUS, METHOD FOR GENERATING MUSICAL SOUND INFORMATION

(71) Applicant: YAMAHA Corporation, Hamamatsu (JP)

(72) Inventors: Masahiko Hasebe, Hamamatsu (JP); Shinichi Ito, Hamamatsu (JP); Kenichi Nishida, Hamamatsu (JP); Masahiro Kakishita, Hamamatsu (JP); Shinichi Ohta, Hamamatsu (JP)

(73) Assignee: YAMAHA CORPORATION, Shizuoka (JP)

( * ) Notice: Subject to any disclaimer, the term of this patent is extended or adjusted under 35 U.S.C. 154(b) by 0 days.

(21) Appl. No.: 16/953,542

(22) Filed: Nov. 20, 2020

(65) Prior Publication Data

US 2021/0151019 A1 May 20, 2021

(30) Foreign Application Priority Data

Nov. 20, 2019 (JP) ..... JP2019-209372

(51) Int. Cl.
*G10H 1/34* (2006.01)
*G10H 1/26* (2006.01)
*G10H 1/44* (2006.01)

(52) U.S. Cl.
CPC ..... *G10H 1/344* (2013.01); *G10H 1/26* (2013.01); *G10H 1/44* (2013.01); *G10H 2220/231* (2013.01)

(58) Field of Classification Search
CPC ..... G10H 1/344; G10H 1/26; G10H 1/44; G10H 2220/231
See application file for complete search history.

(56) References Cited

U.S. PATENT DOCUMENTS 2,562,471 A * 7/1951 Martenot ..... G10H 1/055 84/423 R
3,681,507 A * 8/1972 Slaats ..... G10H 1/34 84/718
3,715,447 A * 2/1973 Ohno ..... G10H 1/055 84/699
3,727,510 A * 4/1973 Cook, Sr. ..... G10B 3/10 84/369

(Continued)

FOREIGN PATENT DOCUMENTS

JP H0594182 U 12/1993
JP 2007256413 A 10/2007

*Primary Examiner* — Robert W Horn
(74) *Attorney, Agent, or Firm* — Chip Law Group

(57) ABSTRACT

A musical sound producing apparatus includes a plurality of keys; a sound production information generator configured to generate sound production information for producing a musical sound based on a first key operation on any key among the plurality of keys; a control information generator configured to generate control information for controlling, on the basis of a second key operation different from the first key operation, a mode of the musical sound produced on the basis of the first key operation; and a musical sound signal generator configured to generate a musical sound signal on the basis of the sound production information and the control information.

13 Claims, 7 Drawing Sheets

(56) References Cited

U.S. PATENT DOCUMENTS

| | | | | |
|---|---|---|---|---|
| 4,068,552 | A * | 1/1978 | Allen | G10H 1/344 84/236 |
| 4,498,365 | A * | 2/1985 | Tripp | G10H 1/055 84/433 |
| 4,665,788 | A * | 5/1987 | Tripp | G10H 1/055 341/33 |
| 6,703,552 | B2 * | 3/2004 | Haken | G10H 1/0555 84/423 R |
| 7,723,597 | B1 * | 5/2010 | Tripp | G10H 1/344 84/423 R |
| 9,324,310 | B2 * | 4/2016 | McPherson | G10H 1/02 |
| 9,711,120 | B1 * | 7/2017 | Pogoda | G10H 1/34 |
| 9,805,705 | B2 * | 10/2017 | McPherson | G06F 3/044 |
| 10,170,089 | B2 * | 1/2019 | Shi | H05B 45/10 |
| 10,978,031 | B2 * | 4/2021 | Hasebe | G10H 1/0008 |
| 2014/0202313 | A1 * | 7/2014 | Prichard | G10H 1/344 84/423 R |
| 2021/0151019 | A1 * | 5/2021 | Hasebe | G10H 1/0091 |

* cited by examiner

MUSICAL SOUND INFORMATION OUTPUTTING APPARATUS, MUSICAL SOUND PRODUCING APPARATUS, METHOD FOR GENERATING MUSICAL SOUND INFORMATION

BACKGROUND

The present disclosure relates to a musical sound information outputting apparatus, a musical sound producing apparatus, a method for generating musical sound information, and a program, for example.

There have been apparatuses capable of producing a musical sound with a keyboard and controlling an effect to be applied to the musical sound. One example of such apparatuses is disclosed in Japanese Patent Laid-Open No. 2007-256413 (hereinafter referred to as Patent Document 1). According to the technique disclosed in Patent Document 1, the apparatus can detect the position of a finger of the user (performer) on a keyboard and control a musical sound on the basis of the position and movement detected. As another example, Japanese Patent Laid-Open No. Hei 05-94182 (hereinafter referred to as Patent Document 2) proposes a technique by which the pitch of a musical sound is raised or lowered according to the operation of an operation device such as a wheel, which is provided separately from a keyboard.

SUMMARY

The present disclosure is desirable to provide a technique that facilitates sound production and effect control with a simple configuration.

DETAILED DESCRIPTION

First Embodiment

Figure 1:
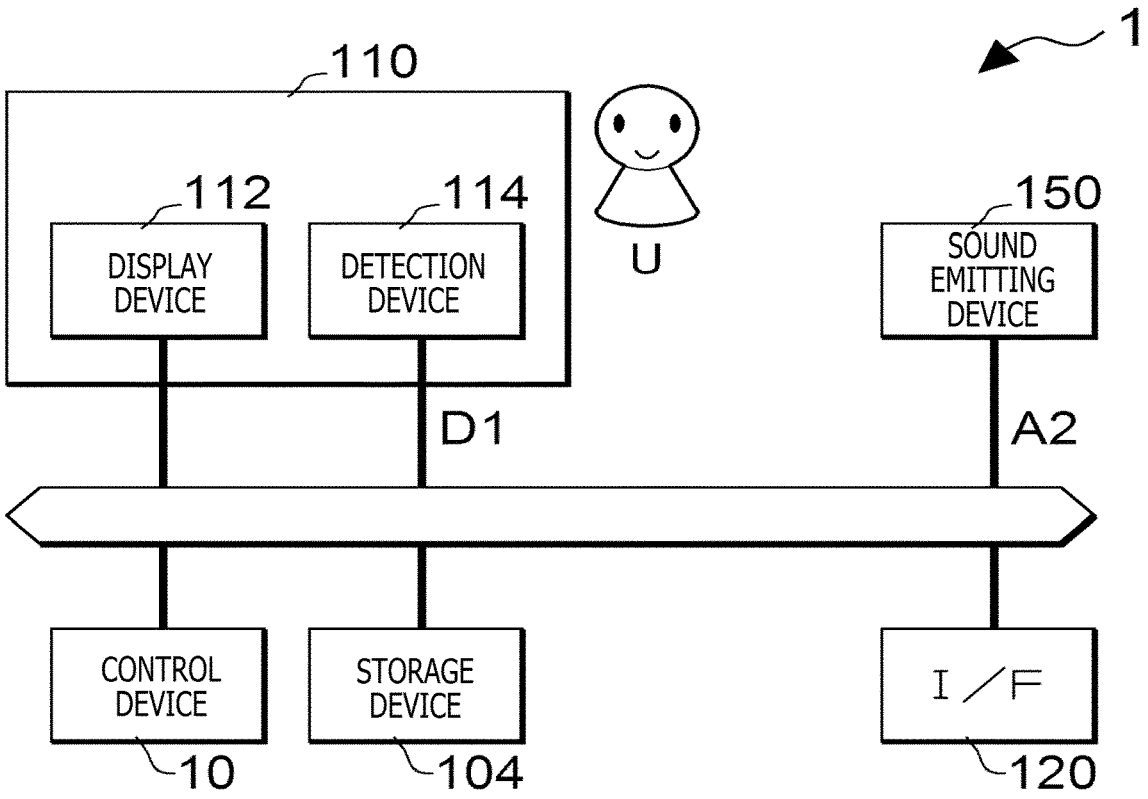
FIG. 1 is a diagram illustrating a configuration of a musical sound producing apparatus according to a first embodiment.

FIG. 1 is a diagram illustrating an example of a musical sound producing apparatus 1 according to a first embodiment. The musical sound producing apparatus 1 produces a musical sound according to a key operation performed by a user U. The musical sound producing apparatus 1 also controls an effect to be applied to the musical sound, according to a key operation that is different from the key operation described above.

The musical sound producing apparatus 1 is implemented by a computer system including a control device 10, a storage device 104, a keyboard device 110, an interface (IF) 120, and a sound emitting device 150. The musical sound producing apparatus 1 is an information terminal, such as a smartphone or a tablet-type personal computer, for example. The components of the musical sound producing apparatus 1 are connected to each other through one or a plurality of buses.

The control device 10 includes one or a plurality of processing circuits such as a central processing unit (CPU), for example, and controls each component of the musical sound producing apparatus 1.

The storage device 104 includes one or a plurality of memories including a known recording medium such as a magnetic recording medium or a semiconductor recording medium, for example. The storage device 104 stores a program to be executed by the control device 10 and various kinds of data used by the control device 10. The storage device 104 may include a combination of multiple types of recording media. The storage device 104 may be a portable recording medium that is detachable to the musical sound producing apparatus 1 or an external recording medium (e.g., an online storage) that can communicate with the musical sound producing apparatus 1 via an unillustrated communication network.

The keyboard device 110 is a touch screen with a combination of a display device 112 and a detection device 114. Specifically, the display device 112 is a liquid crystal display panel or the like. The detection device 114 is provided in the screen surface of the display device 112. The detection device 114 detects two or more positions of operations performed by the user U and outputs position information D1 indicating each of the positions operated. When the user U operates a key of the keyboard device 110 displayed on the display device 112, the musical sound producing apparatus 1 produces a musical sound corresponding to the key operated by the user U.

Musical sounds produced by the musical sound producing apparatus 1 are not limited to musical sounds of keyboard instruments such as a piano and an organ. The musical sound producing apparatus 1 can produce the timbres of sounds of various musical instruments such as a guitar and a trumpet. Moreover, the musical sound producing apparatus 1 can apply various effects to the musical sounds as described later. Upon performance, the keyboard device 110 is displayed on the display device 112. In the setting mode before the performance, various switches and the like are displayed on the display device 112. In this setting mode, for example, the user U sets the timbre of a musical sound and the type of effect to apply.

The interface (I/F) 120 is used to communicate with external apparatuses. The external apparatuses include online storages and servers, which are connected via the above-described communication network, and musical instrument digital interface (MIDI) devices.

The sound emitting device 150 is a speaker or headphones that convert a musical sound signal A2 generated by the control device 10 into a sound. In practice, the musical sound signal A2 is converted into an analog signal by an unillustrated digital-to-analog (D/A) converter, amplified by an unillustrated amplifier, and converted into a sound by the sound emitting device 150. The sound emitting device 150 may be provided as a device separate from the musical sound producing apparatus 1.

Figure 2:
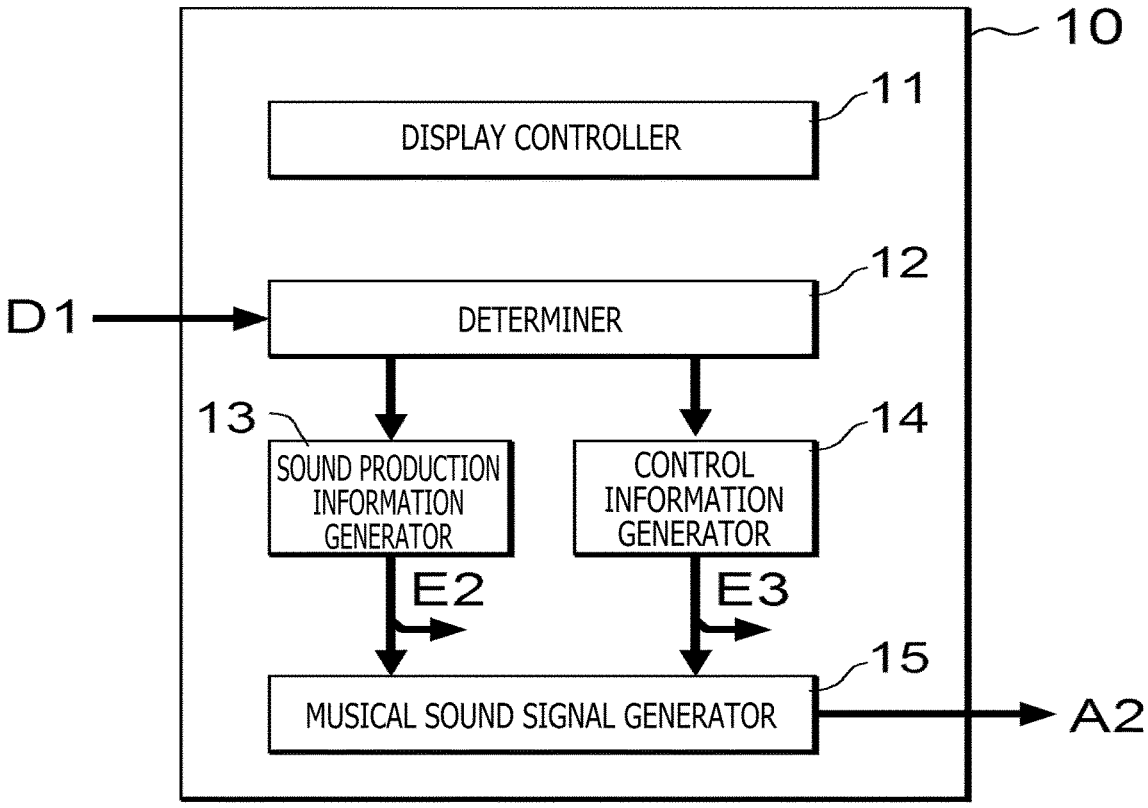
FIG. 2 is a block diagram illustrating functions implemented by a control device in the musical sound producing apparatus.

FIG. 2 is a diagram illustrating a configuration of functions implemented by the control device 10 executing the program stored in the storage device 104. The control device 10 includes a display controller 11, a determiner 12, a sound production information generator 13, a control information generator 14, and a musical sound signal generator 15.

The display controller 11 controls the display contents of the display device 112.

Upon performance, the display controller 11 causes the display device 112 to display a keyboard. When a key of the keyboard is operated, for example, the display controller 11 causes the display device 112 to display the key as if the key were depressed, in response to the operation. Before the performance, the display controller 11 causes the display device 112 to display switches and the like for various settings.

Upon performance, the determiner 12 compares the position of the operation indicated by the position information D1 with the keyboard displayed on the display device 112 by the display controller 11. The determiner 12 then determines which part of the displayed keyboard has been operated and controls the sound production information generator 13 and the control information generator 14 according to the result of the determination.

For convenience, the keyboard displayed on the display device 112 will be described.

Figure 3:
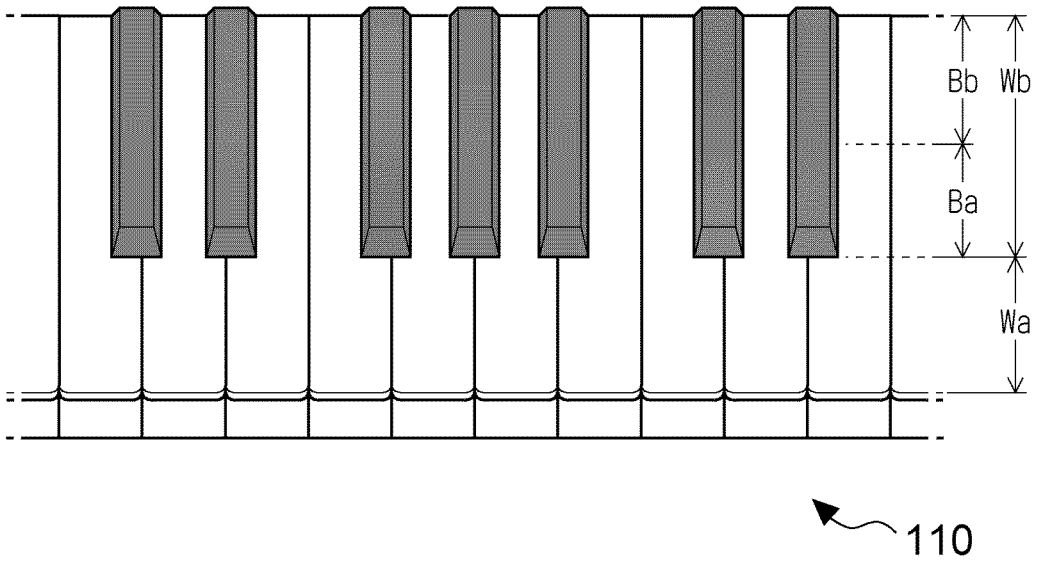
FIG. 3 is a diagram illustrating an example of a keyboard displayed on the musical sound producing apparatus.

FIG. 3 illustrates a part of the keyboard device 110 displayed on the display device 112. The keyboard device 110 includes a plurality of keys. To detect the operation on each key in the keyboard device 110, a detection region is divided into two regions. Specifically, the detection region of each white key is divided into a first region Wa and a second region Wb. The first region Wa is located on the proximal side of each white key (located on the near side of the user U and the lower side of FIG. 3). The second region Wb is located on the distal side of each white key (located on the upper side of FIG. 3). Similarly, the detection region of each black key is divided into a first region Ba and a second region Bb. The first region Ba is located on the proximal side of each black key. The second region Bb is located on the distal side of each black key.

The following describes a touch on each region performed as a key operation. A touch on the first region Wa of a certain white key designates the production of a sound of the touched white key. A touch on the second region Wb of the white key designates the application of an effect to the sound produced. A slide in the second region Wb designates the control of the effect. The slide here refers to the movement of a touch position while the touch is continued. Accordingly, the slide causes a value of an effect parameter to increase or decrease depending on the touch position. The effect parameter defines the contents of the effect.

The same applies to the black keys. A touch on the first region Ba of a certain black key designates the production of a sound of the touched black key. A touch on the second region Bb designates the application of an effect to the sound produced. A slide in the second region Bb designates the control of the effect.

As a key operation, a release of a touch on the first region Wa or Ba of a certain key designates silencing of the key. A release of a touch on the second region Wb or Bb of a certain key designates a stop of the effect application to the sound produced for the key.

Figure 4:
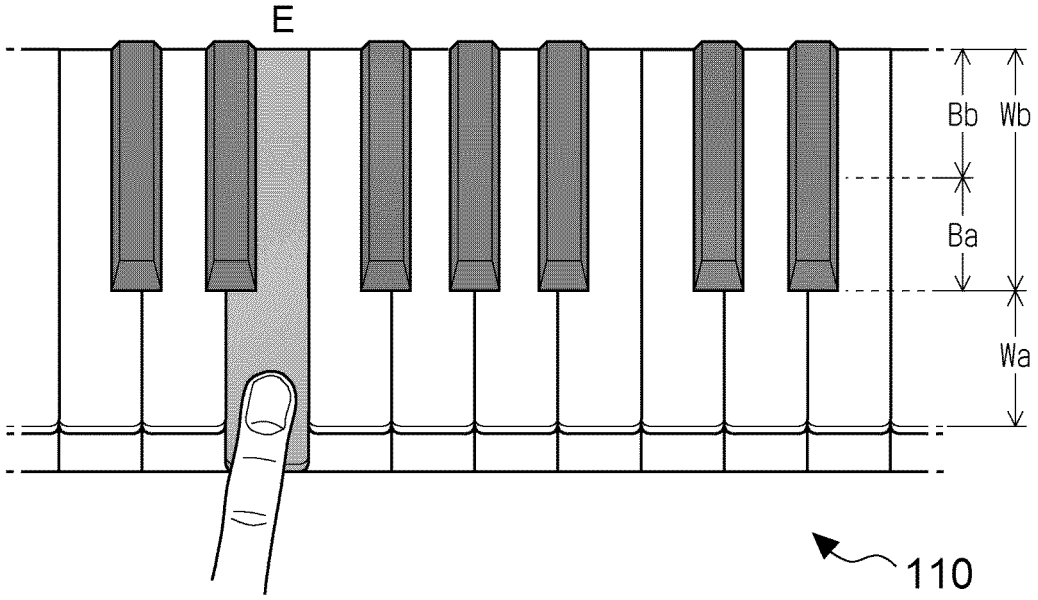
FIG. 4 is a diagram illustrating an example of a key operation in the musical sound producing apparatus.

The sound production and effect application through the key operations will be described in detail. As an example, in the musical sound producing apparatus 1, the first region Wa of a key E, which is included in the keyboard device 110, is touched as illustrated in FIG. 4. In this case, the touch on the first region Wa of the key E designates the production of a sound corresponding to the key E.

Figure 5:
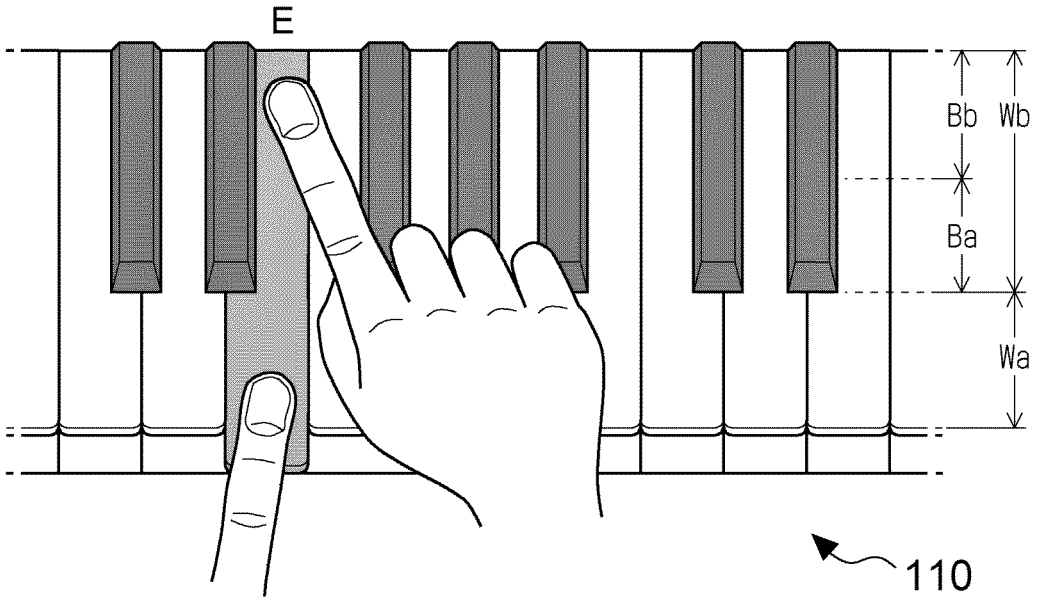
FIG. 5 is a diagram illustrating an example of key operations in the musical sound producing apparatus.

Referring to FIG. 5, the second region Wb of the key E is touched while the first region Wa of the key E is being touched. In this case, the touch on the second region Wb of the key E designates the application of an effect, which has been set in the setting mode, to the sound produced for the key E. In the example of FIG. 5, the first region Wa of the key E is touched by a finger of the left hand while the second region Wb of the key E is touched by a finger of the right hand. Alternatively, these touches may be made simultaneously with different fingers of either the right or left hand.

Figure 6:
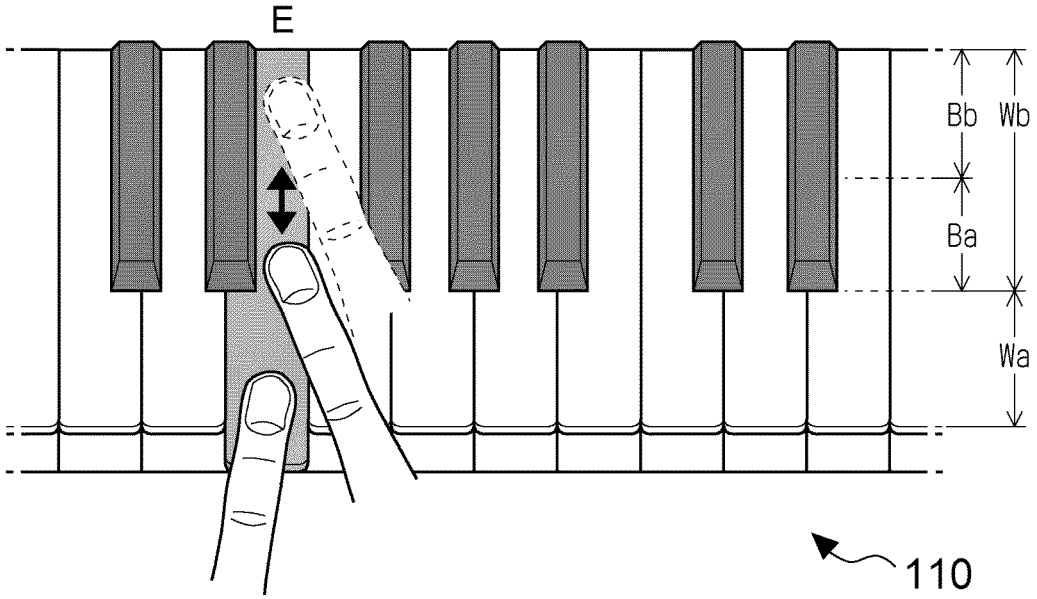
FIG. 6 is a diagram illustrating an example of key operations in the musical sound producing apparatus.

As illustrated in FIG. 6, a slide in the second region Wb of the key E designates an increase or decrease in a parameter according to a change direction of the slide and the touch position.

Although the key operations on the white key have been described with reference to FIGS. 4 to 6, the same applies to the key operations on any black key.

The keys displayed on the display device 112 cannot be physically depressed. Therefore, among the key operations described, the operation for designating the sound production is actually a touch on a certain key. However, as described later, the keyboard device 110 applied to the musical sound producing apparatus 1 is not limited to the display performed by the display device 112.

Referring back to FIG. 2, when the determiner 12 determines that the position of the operation indicated by the position information D1 is in the first region Wa or Ba, the determiner 12 controls the sound production information generator 13. When the determiner 12 determines that the position of the operation indicated by the position information D1 is in the second region Wb or Bb, the determiner 12 controls the control information generator 14.

The sound production information generator 13 outputs sound production information E2. The sound production information E2 is used to produce or silence a sound corresponding to the key operated. Silencing is a mode of the sound production and is included in the sound production.

When the sound production is designated, the sound production information E2 includes note-on information, note number information, and velocity information. The note-on information designates the production of a sound of the touched key. The note number information indicates the pitch of the key. The velocity information indicates the volume of the sound. When silencing is designated, the sound production information E2 includes note-off information and note number information.

A typical keyboard apparatus in which a key physically oscillates can output velocity information reflecting the key depression velocity. However, since the keys displayed on the display device 112 cannot be physically depressed, a value set in the setting mode is output as the velocity information in the present embodiment. If the keyboard apparatus is capable of detecting the key depression velocity, velocity information reflecting the detected key depression velocity may be output.

The control information generator 14 outputs control information E3. The control information E3 is used to apply an effect corresponding to a touch or a slide that is a continuation of the touch.

For example, assume that the effect is a pitch bend that changes the pitch after a sound is produced. In this case, the control information E3 includes a value that designates the amount of change in the pitch. As another example, assume that the effect is a mute that reduces the volume after a sound is produced. In this case, the control information E3 includes a value that designates a change (inclination) in the silence direction. Likewise, if the effect is a distortion that distorts a sound produced, the control information E3 includes a value that designates the amount of distortion. In this manner, the control information E3 includes a value that corresponds to the type of effect.

The control information E3 changes over time according to the slide.

The musical sound signal generator 15 produces a musical sound on the basis of the sound production information E2 and generates the musical sound signal A2 in which an effect based on the control information E3 is applied to the musical sound. The musical sound signal A2 is digital data that designates the waveform of the musical sound in chronological order.

To cause an external apparatus to produce a musical sound, the sound production information E2 and the control information E3 may be supplied to the external apparatus via the interface 120. When the musical sound is produced by the external apparatus, the musical sound signal generator 15 and the sound emitting device 150 do not need to be included in the musical sound producing apparatus 1. In this case, the musical sound producing apparatus 1 functions as a musical sound information outputting apparatus that outputs the sound production information E2 and the control information E3.

Next, the operation of the musical sound producing apparatus 1 will be described.

Figure 7:
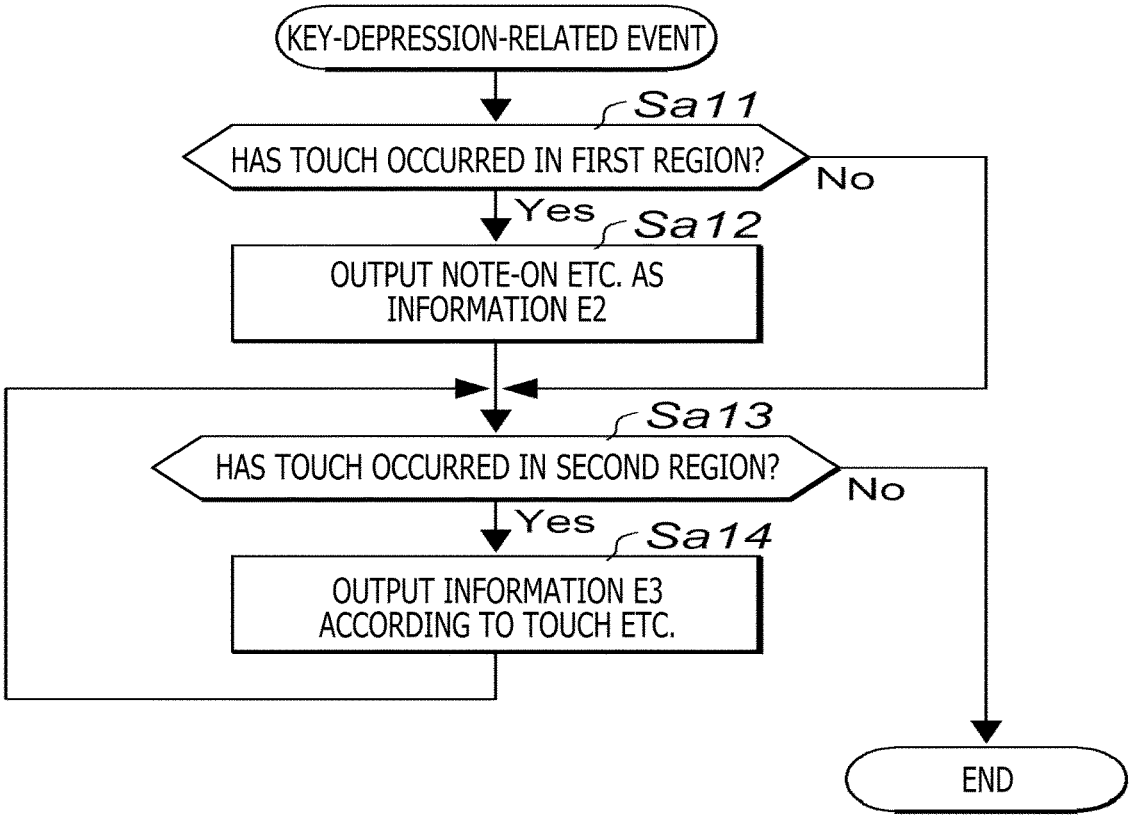
FIG. 7 is a flowchart illustrating an operation of the musical sound producing apparatus.

FIG. 7 is a flowchart illustrating processing of a key-depression-related event in the musical sound producing apparatus 1. The key-depression-related event is an event where the user U has touched one of the plurality of keys in the keyboard device 110.

Upon occurrence of the key-depression-related event, the determiner 12 determines whether or not the touch in this event has occurred in the first region Wa or Ba (step Sa11).

When the touch has occurred in the first region Wa or Ba (when the determination result is "Yes" in step Sa11), the touch is the designation of the sound production. Therefore, the determiner 12 controls the sound production information generator 13. Under this control, the sound production information generator 13 outputs the sound production information E2 used to produce a sound corresponding to the touched key (step Sa12). Accordingly, the musical sound signal generator 15 generates the musical sound signal A2 on the basis of the sound production information E2, and the sound emitting device 150 (or an external apparatus) produces the sound based on the musical sound signal A2.

After step Sa12 or when the determiner 12 determines that the touch has not occurred in the first region Wa or Ba (when the determination result is "No" in step Sa11), the determiner 12 determines whether or not the touch has occurred or continued in the second region Wb or Bb (step Sa13). It is noted that since a slide is a temporally continuing touch, the slide is included in the touch here.

When a touch has occurred or continued in the second region Wb or Bb (when the determination result is "Yes" in step Sa13), the touch is the designation of effect application or the designation of a change in an effect parameter. Therefore, the determiner 12 controls the control information generator 14. Under this control, the control information generator 14 outputs the control information E3 for applying the effect (step Sa14). Specifically, when the touch is a first touch, the control information generator 14 outputs an initial value of the effect parameter as the control information E3. When the touch is a slide, the control information generator 14 outputs a value of the effect parameter according to the touch position. The first touch here refers to a temporally first touch, regardless of whether the touch is a slide or not. When there is no change between the touch position this time and the touch position at the time of previous performance of step Sa14 was, the value of the effect parameter is not changed.

In response, the musical sound signal generator 15 applies the effect based on the control information E3 to the musical sound signal A2. In this manner, the effect corresponding to the touch on the second region Wb or Bb is applied to the musical sound produced by the sound emitting device 150 (or the external apparatus).

After step Sa14, the processing procedure returns to step Sa13. When the touch has continued and its position has been moved in the second region Wb or Bb, the control information generator 14 changes the value of the effect parameter according to the moved touch position.

When the touch on the second region Wb or Bb ends (when the determination result is "No" in step Sa13), the processing of the key-depression-related event ends.

In this key-depression-related event, when a touch has occurred in the first region Wa or Ba, a musical sound corresponding to the touched key is produced. When a touch has occurred in the second region Wb or Bb, an effect set in advance is applied to the musical sound corresponding to the touched key. When the touch position in the second region Wb or Bb has moved (slid), an effect parameter increases or decreases according to the slide through repetition of steps Sa13 and Sa14.

Figure 8:
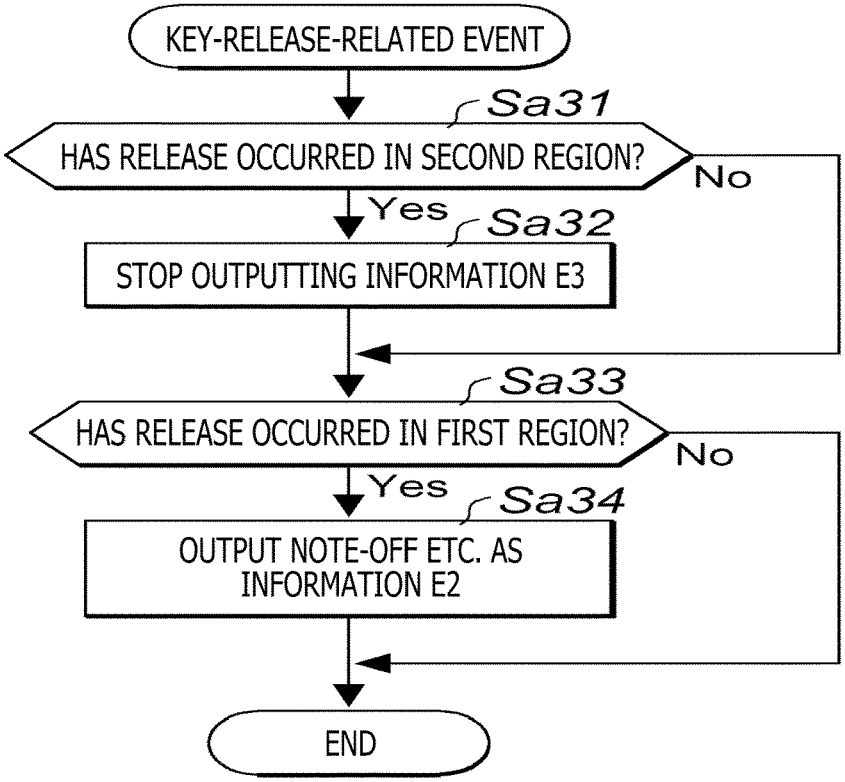
FIG. 8 is a flowchart illustrating an operation of the musical sound producing apparatus.

FIG. 8 is a flowchart illustrating processing of a key-release-related event in the musical sound producing apparatus 1. The key-release-related event is an event where the user U has released one of the keys touched in the keyboard device 110.

Upon occurrence of the key-release-related event, the determiner 12 determines whether or not the release in this event has occurred in the second region Wb or Bb (step Sa31). When the release has occurred in the second region Wb or Bb (when the determination result is "Yes" in step Sa31), the release is the designation of the end of the effect application. Thus, the determiner 12 causes the control information generator 14 to stop outputting the control information E3 (step Sa32). This causes the musical sound signal generator 15 to stop the effect application based on the control information E3.

After step Sa32 or when the determiner 12 determines that the release has not occurred in the second region Wb or Bb (when the determination result is "No" in step Sa31), the determiner 12 determines whether or not the release has occurred in the first region Wa or Ba (step Sa33).

When the release has occurred in the first region Wa or Ba (when the determination result is "Yes" in step Sa33), the release is the designation of silencing. Therefore, the determiner 12 controls the sound production information generator 13. Under this control, the sound production information generator 13 outputs the sound production information E2 to silence a musical sound corresponding to the released key (step Sa34). In response, the musical sound signal generator 15 performs silencing based on the sound production information E2, thereby silencing the musical sound of the key having been touched.

After step Sa34 or when the determiner 12 determines that the release has not occurred in the first region Wa or Ba (when the determination result is "No" in step Sa33), the processing of the key-release-related event ends.

In the key-release-related event, a release of the second region Wb or Bb stops applying an effect to a musical sound but the musical sound is continuously produced. A release of the first region Wa or Ba stops producing a musical sound corresponding to a key having been touched, regardless of whether an effect has been applied.

With the musical sound producing apparatus 1 according to the first embodiment, the position of the operation for producing a sound and the position of the operation for controlling an effect applied to the produced sound are close to each other in the keyboard device 110, compared with a configuration where an operation device is provided separately from a keyboard device. Therefore, the user can perform the sound production and the effect control more easily.

Moreover, the musical sound producing apparatus 1 according to the first embodiment does not require a component separate from the keyboard device 110 in order to detect the position of a finger of the user U. This prevents the entire apparatus from becoming complicated.

Second Embodiment

The musical sound producing apparatus 1 according to the first embodiment produces a musical sound in response to a touch on the first region Wa or Ba and applies, in response to a touch or the like on the second region Wb or Bb, an effect to the produced musical sound in order to give a change to the musical sound. Put it simply, with the musical sound producing apparatus 1 according to the first embodiment, a touch on the first region Wa or Ba temporally precedes a touch or the like on the second region Wb or Bb.

With the musical sound producing apparatus 1 according to a second embodiment, a touch on the second region Wb or Bb temporally precedes a touch on the first region Wa or Ba.

In the musical sound producing apparatus 1 according to the second embodiment, the musical sound signal generator 15 included in the control device 10 is different from the musical sound signal generator 15 according to the first embodiment. In the second embodiment, therefore, description focuses on the musical sound signal generator 15.

In the second embodiment, it is assumed that a guitar is selected as the timbre of a musical sound to be produced. In the second embodiment, when the second region Wb or Bb of a certain key is touched and then the first region Wa or Ba of the key is touched, a musical sound using a hammer-on technique is produced at the pitch of the key. When the first region Wa or Ba of a certain key is touched without the second region Wb or Bb of the key being touched, a musical sound using a picking technique is produced at the pitch of the key.

The hammer-on technique is a playing technique used to produce a musical sound by striking a string with the force of a finger without using a pick. The picking technique is a playing technique used to produce a musical sound by plucking a string with a pick. There is a clear difference between the musical sound produced using the hammer-on technique and the musical sound produced using the picking technique. In the second embodiment, the musical sound using either of these two techniques is produced depending on how a key is operated. The musical sound produced using the hammer-on technique and the musical sound produced using the picking technique are guitar sounds of the same timbre.

Figure 9:
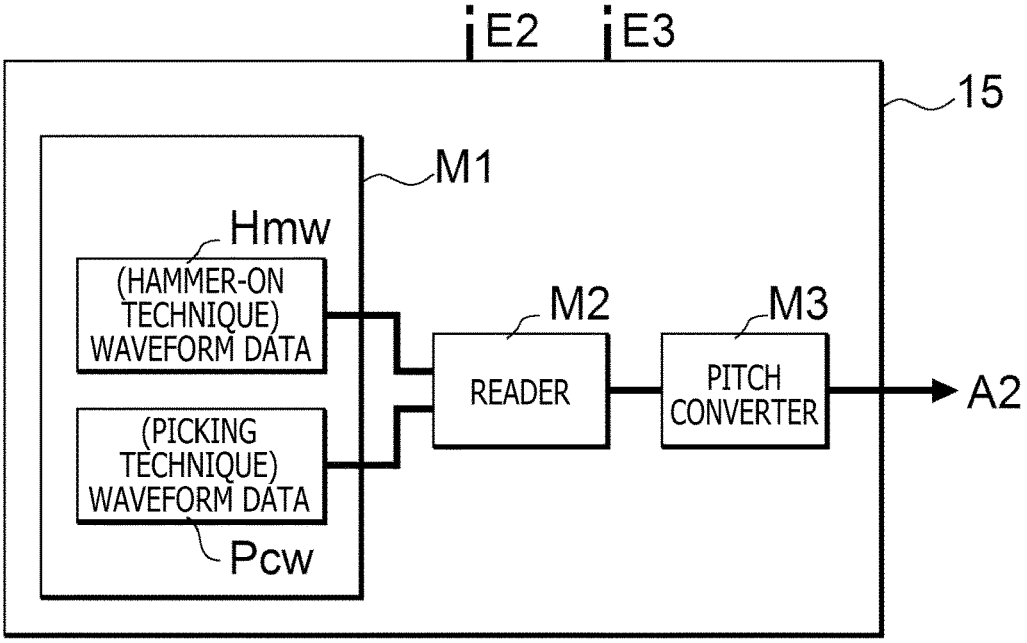
FIG. 9 is a diagram illustrating a musical sound signal generator in the musical sound producing apparatus according to a second embodiment.

FIG. 9 is a diagram illustrating a functional block of the musical sound signal generator 15 according to the second embodiment.

By the control device 10 executing a program stored in the storage device 104, a waveform storage M1, a reader M2, and a pitch converter M3 are implemented in the musical sound signal generator 15.

The waveform storage M1 stores waveform data Hmw for the hammer-on technique and waveform data Pcw for the picking technique. For example, the waveform data Hmw is data obtained by sampling one or more cycles of a guitar sound produced using the hammer-on technique. The waveform data Pcw is data obtained by sampling one or more cycles of a guitar sound produced using the picking technique. When a guitar is selected as the timbre, the waveform data Hmw and the waveform data Pcw are loaded from the storage device 104, for example.

The reader M2 selects either of the waveform data Hmw and the waveform data Pcw on the basis of the sound production information E2 and the control information E3 and repeatedly reads the waveform data selected.

The pitch converter M3 converts the pitch of the read waveform data Hmw or Pcw on the basis of the note number information included in the sound production information E2 and outputs the converted pitch as the musical sound signal A2.

Figure 10:
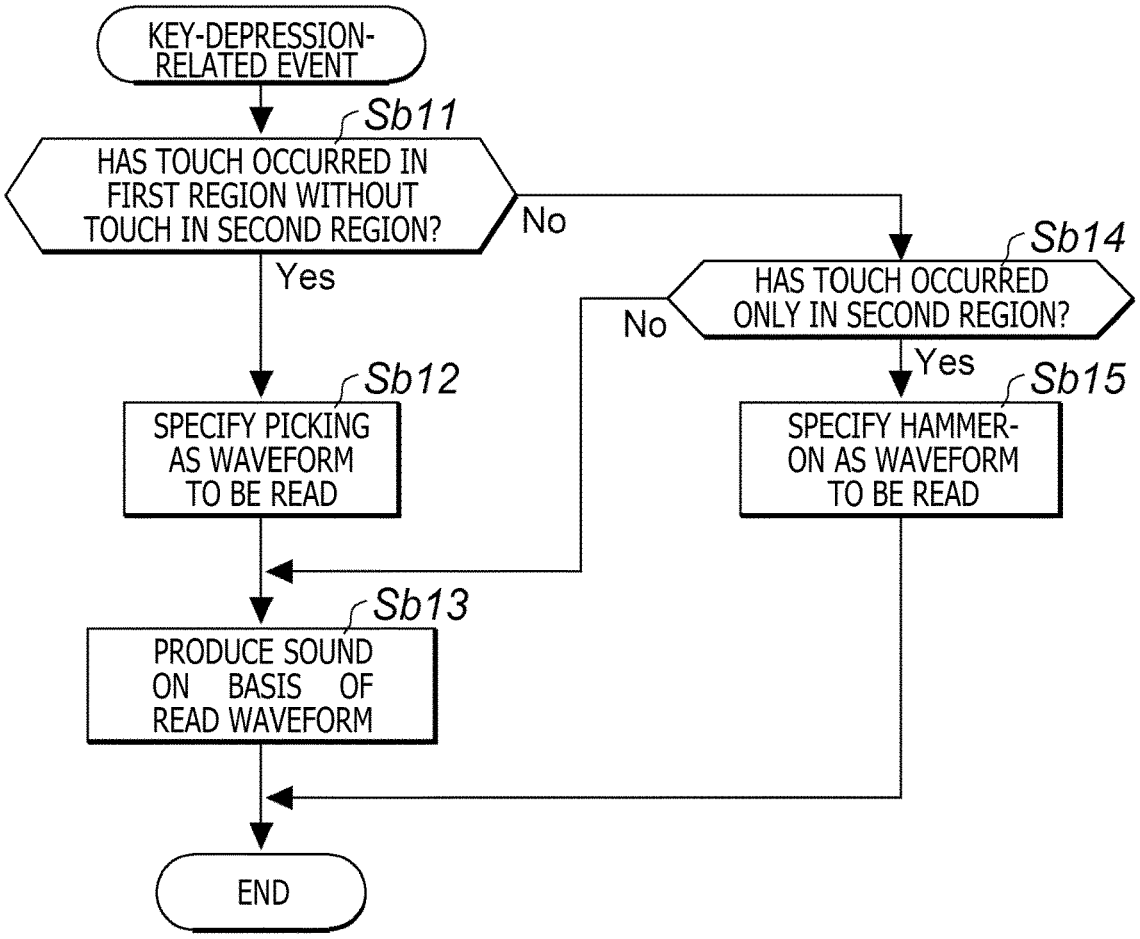
FIG. 10 is a flowchart illustrating an operation of the musical sound producing apparatus.

FIG. 10 is a flowchart illustrating processing of a key-depression-related event in the musical sound producing apparatus 1 according to the second embodiment.

Upon occurrence of the key-depression-related event, the determiner 12 (see FIG. 2) determines whether or not the touch in this event has occurred in the first region Wa or Ba while no touch is continued in the second region Wb or Bb (step Sb11).

When the determination result is "Yes," the touch is the designation of the sound production using the picking technique. Therefore, the determiner 12 controls the control information generator 14. Under this control, the control information generator 14 outputs a notice of the picking technique as the control information E3 (step Sb12). Accordingly, the reader M2 of the musical sound signal generator 15 determines to read the waveform data Pcw from the waveform storage M1. The processing of actually outputting the musical sound signal A2 is performed in step Sb13 described later.

When the determination result is "No" in step Sb11, it indicates that the touch has occurred only in the second region Wb or Bb or the touch has occurred in the first region Wa or Ba while the second region Wb or Bb is continuously touched.

Therefore, the determiner 12 first determines whether or not the touch in this event has occurred only in the second region Wb or Bb (step Sb14).

When the determination result is "Yes" in step Sb14, the touch is a notice of the sound production using the hammer-on technique. Therefore, the determiner 12 controls the control information generator 14. Under this control, the control information generator 14 outputs a notice of the hammer-on technique as the control information E3 (step Sb15). Accordingly, the reader M2 of the musical sound signal generator 15 determines to read the waveform data Hmw from the waveform storage M1.

When the determination result is "No" in step Sb14, it indicates that the touch has occurred in the first region Wa or Ba while the second region Wb or Bb is continuously touched. Since this is the designation of the sound production using the hammer-on technique, the processing procedure proceeds to step Sb13, which is sound production processing. When the determination result is "No" in step Sb14, the reader M2 has already determined to read the waveform data Hmw in step Sb15 of processing performed in the previous key-depression-related event.

After step Sb12 or when the determination result is "No" in step Sb14, the determiner 12 controls the sound production information generator 13. Under this control, the sound production information generator 13 outputs, as E2, sound production information used to produce a sound corresponding to the key of the touched first region Wa or Ba (step Sb13). Accordingly, the reader M2 of the musical sound signal generator 15 reads the determined waveform data, and the pitch converter M3 converts the read waveform data into the pitch corresponding to the note number information included in the sound production information E2 and outputs the pitch as the musical sound signal A2. The sound emitting device 150 (or the external apparatus) produces the sound based on the musical sound signal A2.

After step Sb13 or Sb15, the processing of the key-depression-related event ends.

In the second embodiment, when a touch has occurred only in the second region Wb or Bb of a certain key, the touch is treated as a notice of the hammer-on technique. Accordingly, the waveform data Hmw is determined to be read, and the processing of the key-depression-related event ends temporarily.

When a touch has occurred in the first region Wa or Ba of a certain key while there is no touch in the second region Wb or Bb of the key, a sound is produced using the picking technique (steps Sb12 and Sb13).

When a touch is already continued in the second region Wb or Bb of a certain key by the time a touch occurs in the first region Wa or Ba of the key, a sound is produced using the hammer-on technique determined in the previous execution. That is, the processing of steps Sb14 and Sb15 is performed in the first key-depression-related event, and the processing of steps Sb14 and Sb13 is performed in the second key-depression-related event.

Although a key-release related event is not described in detail in the second embodiment, a release of the first region Wa or Ba is the designation of the end of the sound production. In response to this operation, the determiner 12 causes the sound production information generator 13 to output note-off information, thereby ending the sound production performed in step Sb13. The second region Wb or Bb may be released while no touch occurs in the first region Wa or Ba. In this case, the release may be treated as a cancellation of the notice of the hammer-on technique and the playing technique may be switched to the picking technique. Alternatively, the release may be treated as a continuation of the notice of the hammer-on technique and the notice may not be cancelled.

According to the second embodiment, performing the key operations in the keyboard device 110 can switch between the production of a musical sound using the picking technique and the production of a musical sound using the hammer-on technique.

With the musical sound producing apparatus 1 according to the second embodiment, the position of the key operation for producing a musical sound and the position of the key operation for designating switching of the musical sound using the playing technique are close to each other in the keyboard device 110, compared with a configuration where a separate operation device is provided. Therefore, the user can more easily perform the sound production and switching of a musical sound using the playing technique.

In the second embodiment, a produced musical sound can be switched between the two playing techniques. Alternatively, as described later, a produced musical sound may be switched between three or more types of musical sounds. In this case, the second region may be divided into two or more regions. For example, when the number of operations in the second region is "1," first waveform data may be used. When the number of operations in the second region is "2," second waveform data may be used. When the number of operations in a third region is "3," third waveform data may be used.

Although the switching of the playing technique is determined depending on whether or not the second region is touched, the playing technique may be switched using other methods. For example, in order to switch from one pitch to another, the proximal side of a key of a certain pitch may be operated to produce a sound, and during the production of the sound, a key of a target pitch may be operated. Through these operations, the sound may be produced as the pitch changes. To change the pitch stepwisely, while the distal side of the key of the target pitch is touched, the proximal side may be operated. To change the pitch steplessly in a continuous manner, the distal side of the key whose sound is produced first and the distal side of the key of the target pitch may be touched simultaneously, and the proximal side may be operated.

<Modifications>

The timbre and effect are not limited to those described in the embodiments above. For example, the effect control may be selected for each type or group of musical instruments, such as wind instruments and stringed instruments. Alternatively, the effect control may be common to all selectable timbres. In other words, there may be any relation between the timbre and the effect control.

Figure 11:
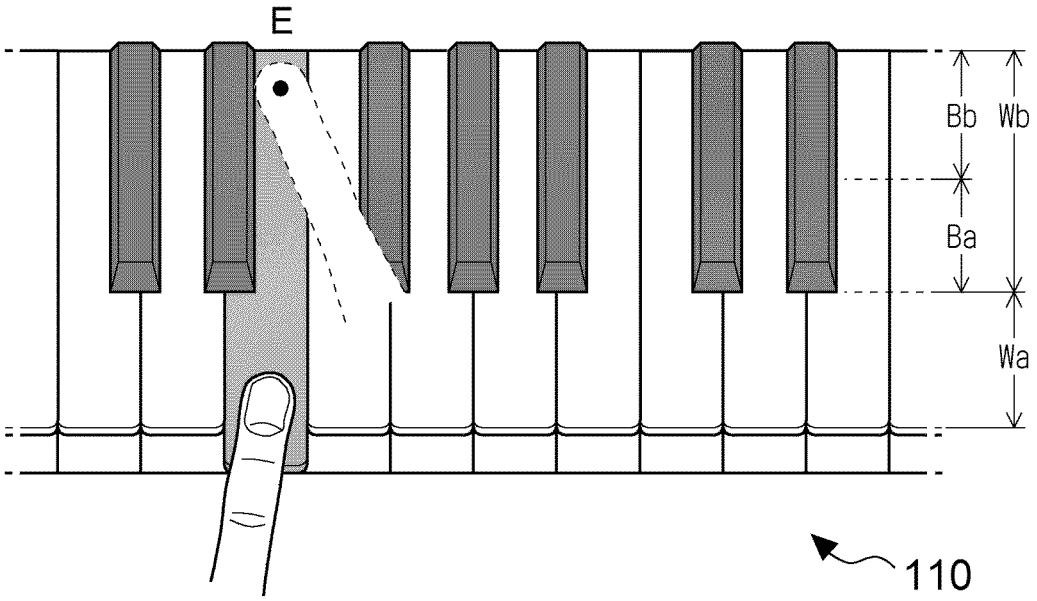
FIG. 11 is a diagram illustrating an example of key operations in the musical sound producing apparatus.
Figure 12:
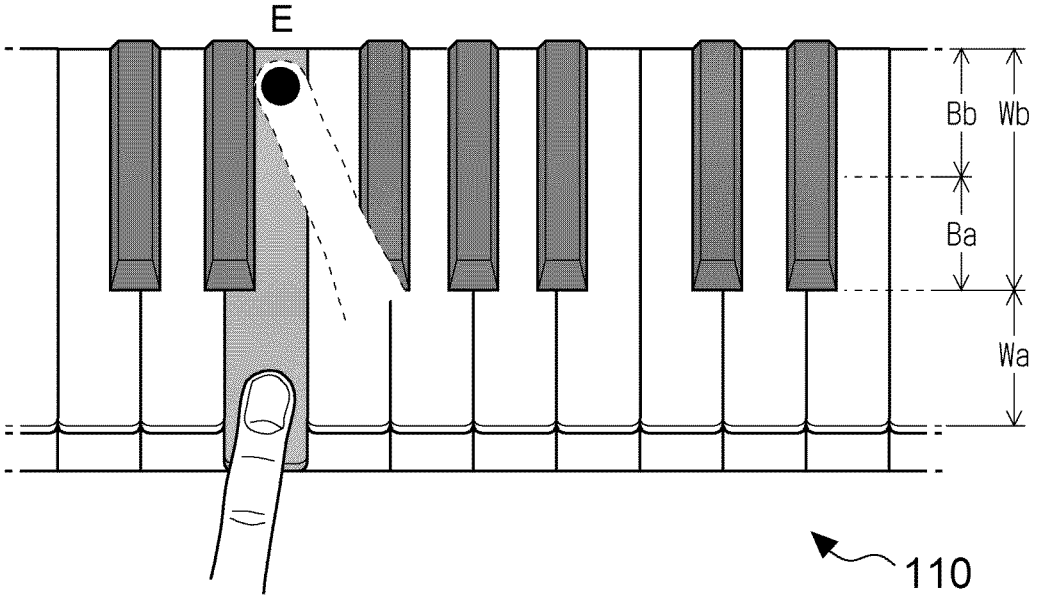
FIG. 12 is a diagram illustrating an example of key operations in the musical sound producing apparatus.

For example, if the detection device 114 is capable of detecting not only the touch position but also a depressing force at the touch position, the value of the effect parameter may be increased or decreased depending on the depressing force, instead of or together with a slide of the touch position in the second region Wb or Bb. For example, when the depressing force on the second region Wb of the key E is small as illustrated in FIG. 11, the effect parameter may be reduced. When the depressing force on the second region Wb of the key E is large as illustrated in FIG. 12, the effect parameter may be increased. Alternatively, the value of the effect parameter may be increased or decreased by weighting the slide and the amount of pressure. Alternatively, the value of the effect parameter may be increased or decreased by allocating a different effect parameter to each of the slide and the amount of pressure.

It is noted that in FIGS. 11 and 12, the size of the black circle represents the magnitude of the depressing force.

Moreover, if the detection device 114 is capable of detecting not only the touch position but also the depressing force, the timing when the depressing force on the first region Wa or Ba reaches or exceeds a threshold value may be detected as a key depressing timing, for example. As the key depression velocity, a value obtained by dividing the threshold value of the depressing force by a period of time from the timing of the first touch to the key depressing timing may be reflected in the velocity information.

To detect not only the touch position but also the depressing force, various methods can be employed. For example, the detection device 114 of the touch screen may be of an electrostatic type. Alternatively, in each of the second regions Wb and Bb of a keyboard device including keys that can actually be depressed, one or more pressure-sensitive switches may be arranged or an electrostatic sensor and a pressure sensor whose detection ranges include the corresponding second region Wb or Bb may be arranged.

It is possible to employ a keyboard having what is generally called a pantograph-type elevating structure where the user can depress not only the proximal side but also the distal side of each key. With this keyboard, the depression of the proximal side of a key may be used to produce a sound, while the depression of the distal side may be used to control an effect, for example.

As long as the operation on the proximal side of a key and the operation on the distal side of the key can be distinguished in this manner, any types of keyboard devices can be employed.

Figure 13:
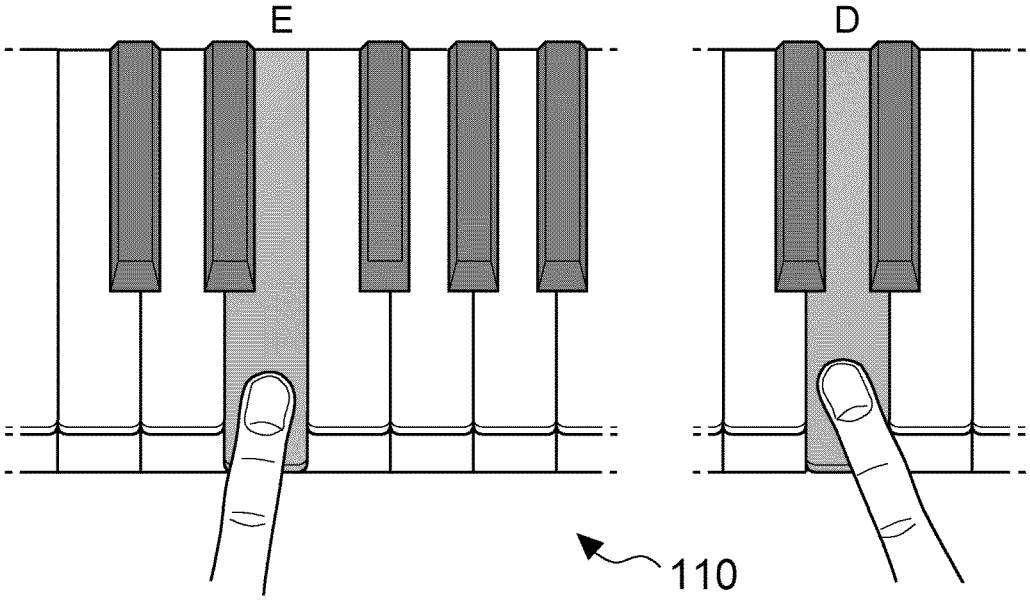
FIG. 13 is a diagram illustrating an example of key operations in the musical sound producing apparatus.

The keys for designating the sound production and the keys for designating and controlling effects may be divided into different regions. For example, as illustrated in FIG. 13, a key region on the low-frequency side may be allocated to the sound production while a key region on the high-frequency side may be allocated to the effect control. A plurality of keys on the high-frequency side allocated to the effect control may be allocated to designate effects different from each other or may be allocated to apply different magnitudes of the same effect.

For example, in FIG. 13, when the key E on the low-frequency side is operated, the sound corresponding to the key E is produced. When a key D on the high-frequency side is operated, an effect allocated to the key D is applied.

When the keys for designating the sound production and the keys for designating and controlling the effects are divided into different regions, a key region other than a key region of the sound production band used by a musical instrument of a produced musical sound may be allocated to the designation and control of the effects.

Figure 14:
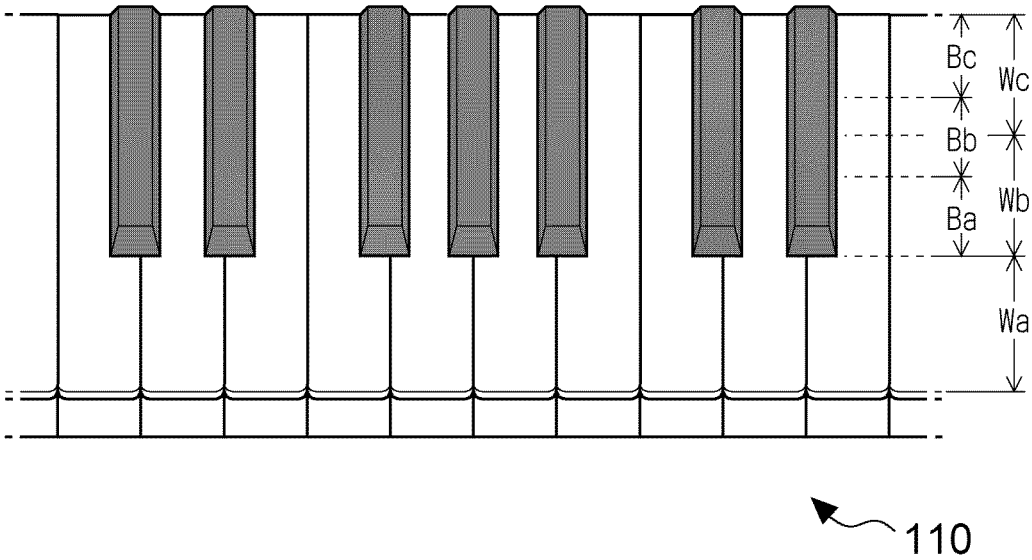
FIG. 14 is a diagram illustrating an example of how detection regions are divided in each key.

The second region may further be divided into two or more regions. For example, as illustrated in FIG. 14, the second region of each white key may be divided into two regions of Wb on the proximal side and Wc on the distal side. Further, the second region of each black key may be divided into two regions of Bb on the proximal side and Bc on the distal side.

When the second region is divided into two regions, the two regions may be allocated to different effects. For example, the second regions Wb and Bb on the proximal side may be allocated to a pitch bend while the second regions Wc and Bc on the distal side may be allocated to a mute.

Although the control of a mode of producing a single sound has been described as an example in the embodiments above, multiple sounds may be produced. Specifically, each time the user touches (depresses) a key, a sound production channel may sequentially be allocated to produce musical sounds. Each time the user releases the key, the allocated sound production channel may be released.

Moreover, the present embodiment may be applied to a control of a sound production mode of an automatic accompaniment. For example, the user may touch the distal side of a key to designate a chord with a single finger. In this case, the playing technique may be switched so as to produce an accompaniment sound using an extended technique. When the distal side of a key is touched during the production of an accompaniment sound, a mute effect may be applied.

Although the sound production information generator and the control information generator are operated separately in the above-described embodiments, musical sounds of different modes may be produced (overlapped) according to the regions operated. For example, in the case of a guitar timbre, a fret noise may be produced in response to an operation on the first region, while a guitar sound, which is the sound of the guitar main body, may be produced in response to an operation on the second region. In the case of a flute timbre, a jet noise may be produced in response to an operation on the first region, while a flute sound, which is the sound of the flute main body, may be produced in response to an operation on the second region.

<Appendix>

For example, the following modes are understood from the embodiments and modifications described above.

A musical sound information outputting apparatus according to a mode (a first mode) of the present disclosure includes a plurality of keys; a sound production information generator configured to generate sound production information for producing a musical sound based on a first key operation on any key among the plurality of keys; and a control information generator configured to generate control information for controlling, on the basis of a second key operation different from the first key operation, a mode of the musical sound produced on the basis of the first key operation.

According to the first mode, the position of the first key operation for producing a musical sound and the position of the second key operation for controlling a mode of the produced musical sound are both located on the plurality of keys and are close to each other compared with a configuration where a separate operation device for controlling the mode of the musical sound is provided. Therefore, the user can more easily perform the operation for producing a musical sound and the operation for controlling the mode of the musical sound.

Examples of the control of the mode of a musical sound include application of an effect to the musical sound and switching of the type of musical sound, e.g., switching of data used for producing the musical sound. Further, the mode of a produced musical sound may be controlled either to change the musical sound which has already been produced or to change the mode of the musical sound which is to be produced, according to the second key operation.

The second key operation, which is different from the first key operation, may be performed either on the same key as the first key operation but at a different operating position or on a key different from the first key operation. Moreover, the first key operation may temporally precede the second key operation, or vice versa.

The sound production information generator and the control information generator may be operated in this order, or vice versa.

In an example (a second mode) of the first mode, the second key operation is an operation performed after the first key operation such that an amount of the operation on a key, among the plurality of keys, changes over time, and the control information generator generates the control information according to the change in the amount of the operation. According to the second mode, the mode of the musical sound is controlled according to the operation performed such that the amount of the operation changes over time. Therefore, the user can easily control the mode of the musical sound.

Examples of the amount of the operation on the key include a relative or absolute operating position with respect to the key, the amount of stroke of the key depression, and a depressing force on the key.

In an example (a third mode) of the first mode, the key includes a first region located on a near side of an operator and a second region other than the first region, the first key operation is an operation of depressing the first region of the key, and the second key operation is an operation on the second region of the key. According to the third mode, the second key operation is performed on the same key as the first key operation. Therefore, compared with the first mode, the user may more easily perform the operation for producing a musical sound and the operation for controlling the mode of the musical sound. The key depressing operation includes not only an operation in which the user actually depresses the key, but also an operation as if the user depressed the key displayed on the screen.

In an example (a fourth mode) of the first mode, the second key operation is an operation performed such that an amount of the operation on the second region changes over time, and the control information generator generates control information for controlling, according to the change in the second region, the mode of the musical sound based on the first key operation.

According to the fourth mode, the second key operation is performed on the same key as the first key operation. More specifically, the second key operation is performed on the second region of this key. Therefore, compared with the first mode, the user may more easily perform the operation for producing a musical sound and the operation for controlling the mode of the musical sound.

In an example (a fifth mode) of the first mode, a key, among the plurality of keys, on which the second key operation is performed is different from the key on which the first key operation is performed, and the control information generator generates the control information according to the second key operation. According to the fifth mode, the key on which the second key operation is performed is different from the key on which the first key operation is performed. Therefore, the user can operate the key for producing a musical sound distinctively from the key for controlling the mode of the musical sound.

A musical sound producing apparatus according to a mode (a sixth mode) of the present disclosure includes a plurality of keys; a sound production information generator configured to generate sound production information for producing a musical sound based on a first key operation on any key among the plurality of keys; a control information generator configured to generate control information for controlling, on the basis of a second key operation different from the first key operation, a mode of the musical sound produced on the basis of the first key operation; and a musical sound signal generator configured to generate a musical sound signal on the basis of the sound production information and the control information. According to the sixth mode, as with the first mode, the user can easily perform the operation for producing a musical sound and the operation for controlling the mode of the musical sound.

In an example (a seventh mode) of the sixth mode, when the first key operation is performed after the second key operation, the musical sound signal generator generates, on the basis of first waveform data, a musical sound signal based on the first key operation, and when the first key operation is performed without the second key operation being performed, the musical sound signal generator generates, on the basis of second waveform data different from the first waveform data, a musical sound signal based on the first key operation.

According to the sixth mode, the musical sound signal based on the first and second key operations can be differentiated from the musical sound signal based only on the first key operation.

The musical sound information outputting apparatus according to each of the above-exemplified modes can be implemented as a method for outputting musical sound information or can be implemented as a program for causing a computer to execute the musical sound information outputting apparatus. Similarly, the musical sound producing apparatus can be implemented as a method for producing a musical sound or can be implemented as a program for causing a computer to execute the musical sound producing apparatus.

In the method, the sound production information may be generated temporally before the control information, or vice versa. In the program, the sound production information generator and the control information generator may function in this order, or vice versa.

It should be understood by those skilled in the art that various modifications, combinations, sub-combinations and alterations may occur depending on design requirements and other factors insofar as they are within the scope of the appended claims or the equivalent thereof.

This application claims the benefit of Japanese Priority Patent Application JP 2019-209372 filed Nov. 20, 2019, the entire contents of which are incorporated herein by reference.

What is claimed is:

1. A musical sound information outputting apparatus, comprising:

a plurality of keys including a first key and a second key;

a sound production information generator configured to generate sound production information to produce a musical sound, wherein the generation of the sound production information is based on a first key operation on a first region of the first key among the plurality of keys; and a control information generator configured to generate control information to control, based on a second key operation on one of a second region of the first key or the second key, a mode of the musical sound, wherein the second key operation is different from the first key operation, the mode of the musical sound comprises a type of effect among a plurality of effects applied to the musical sound based on the second key operation, and the type of effect is set based on user input in a setting mode of the musical sound information outputting apparatus.

2. The musical sound information outputting apparatus according to claim 1, wherein the second key operation is performed after the first key operation such that an amount of an operation on the first key, among the plurality of keys, changes over time, the amount of the operation on the first key includes one of an amount of stroke of a key depression or an amount of depressing force on the first key, and the control information generator is further configured to generate the control information based on the change in the amount of the operation.

3. The musical sound information outputting apparatus according to claim 1, wherein the first region is located on a near side of an operator, and the first key operation includes an operation to depress the first region of the first key, and the second key operation is an operation on one of the second region of the first key or the second key.

4. The musical sound information outputting apparatus according to claim 3, wherein the second key operation is performed such that an amount of the operation on the second region changes over time, and the control information generator is further configured to generate the control information according to the change in the amount of the operation on the second region.

5. The musical sound information outputting apparatus according to claim 1, wherein the first key is on a low-frequency side of the plurality of keys, the second key is on a high-frequency side of the plurality of keys, the second key operation is performed on the second key, and the control information generator is further configured to generate the control information based on the second key operation on the second key.

6. A musical sound producing apparatus, comprising:

a plurality of keys including a first key and a second key;

a sound production information generator configured to generate sound production information to produce a musical sound, wherein the generation of the sound production information is based on a first key operation on a first region of the first key among the plurality of keys; and a control information generator configured to generate control information to control, based on a second key operation on one of a second region of the first key or the second, a mode of the musical sound, wherein the second key operation is different from the first key operation, the mode of the musical sound comprises a type of effect among a plurality of effects applied to the musical sound based on the second key operation, and the type of effect is set based on user input in a setting mode of the musical sound producing apparatus; and a musical sound signal generator configured to generate a musical sound signal based on the sound production information and the control information.

7. The musical sound producing apparatus according to claim 6, further comprising:

a storage device configured to store first waveform data and second waveform data, wherein the second waveform data is different from the first waveform data; and a reader configured to read out one of the stored first waveform data or the second waveform data based on the sound production information and the control information, wherein in a case where the first key operation is performed after the second key operation, the reader reads out the first waveform data, in a case where the first key operation is performed without the second key operation, the reader reads out the second waveform data, the musical sound signal generator is further configured to:

generate, based on the first waveform data read out from the reader and the sound production information, a first musical sound signal in the case where the first key operation is performed after the second key operation; and generate, based on the second waveform data and the sound production information, a second musical sound signal in the case where the first key operation is performed without the second key operation.

8. A method for generating musical sound information, the method comprising:

in a musical sound information outputting apparatus:

generating sound production information regarding a musical sound based on a first key operation on a first region of a first key among a plurality of keys, wherein the plurality of keys includes the first key and a second key; and generating control information to control, based on a second key operation on one of a second region of the first key or the second key, a mode of the musical sound, wherein the second key operation is different from the first key operation, the mode of the musical sound comprises a type of effect among a plurality of effects applied to the musical sound based on the second key operation, and the type of effect is set based on user input in a setting mode of the musical sound information outputting apparatus.

9. The musical sound information outputting apparatus according to claim 1, further comprising a detection device configured to detect an amount of depressing force on the second region of the first key, wherein the depressing force is generated on the second region of the first key by the second key operation different from the first key operation, wherein the control information generator is further configured to generate the control information to control, based on the detected amount of the depressing force on the second region of the first key, the mode of the musical sound, the control information includes a value of an effect parameter corresponding to the detected amount of the depressing force, the control of the value of the effect parameter includes:

an increase in the value of the effect parameter based on an increase in the detected amount of the depressing force, and a decrease in the value of the effect parameter based on a decrease in the detected amount of the depressing force.

10. The musical sound information outputting apparatus according to claim 1, wherein the first key includes a third region different from the first region and the second region, the control information corresponds to a first type of effect on the musical sound in a case where the second key operation is performed on the second region of the first key, and the control information corresponds to a second type of effect, different from the first type of effect, in a case where the second key operation is performed on the third region of the first key.

11. The musical sound information outputting apparatus according to claim 1, wherein the control information generator is further configured to designate a chord based on the second key operation on the second region.

12. The musical sound information outputting apparatus according to claim 1, wherein the control information includes a value of an effect parameter, and the effect parameter is one of a pitch, a volume, or a level of distortion.

13. The musical sound information outputting apparatus according to claim 1, wherein the sound production information includes at least one of note-on information, note number information, or velocity information.

* * * * *